US006736866B2

(12) United States Patent
Tsai

(10) Patent No.: US 6,736,866 B2
(45) Date of Patent: May 18, 2004

(54) EMULSION FUEL OIL AND ITS FORMING METHOD

(76) Inventor: Kune-muh Tsai, 4F-3, No. 127, Sec. 1, Fu-Hsing South Rd., Taipei (TW)

( * ) Notice: Subject to any disclaimer, the term of this patent is extended or adjusted under 35 U.S.C. 154(b) by 0 days.

(21) Appl. No.: 10/190,523

(22) Filed: Jul. 9, 2002

(65) Prior Publication Data

US 2003/0024153 A1 Feb. 6, 2003

(30) Foreign Application Priority Data

Jul. 11, 2001 (TW) ..... 90117007 A

(51) Int. Cl.[7] ..... C10L 1/32
(52) U.S. Cl. ..... 44/301
(58) Field of Search ..... 44/301, 302

(56) References Cited

U.S. PATENT DOCUMENTS 6,068,670 A * 5/2000 Haupais et al. ..... 44/301

FOREIGN PATENT DOCUMENTS

WO WO200000572 * 1/2000

* cited by examiner

*Primary Examiner*—Cephia D. Toomer
(74) *Attorney, Agent, or Firm*—Arent Fox PLLC

(57) ABSTRACT

The present invention discloses an emulsion fuel oil and its forming method. The emulsion fuel oil includes 550–800 parts by weight of a fuel oil, 200–450 parts by weight of a water, and 2–20 parts by weight of an additive including a non-ionic surfactant having an HLB (Hydrophilic-Lipophilic Balance) value ranged from 2.5 to 8, a combustion-assisting reagent, a stabilization reagent and a promotion reagent. The method for forming the emulsion fuel oil includes steps of (a) providing a mixture including 550–800 parts by weight of a fuel oil, 200–450 parts by weight of a water and 2–20 parts by weight of an additive, wherein the additive includes a non-ionic surfactant having an HLB (Hydrophilic-Lipophilic Balance) value ranged from 2.5 to 8, a combustion-assisting reagent, a stabilization reagent and a promotion reagent, (b) stirring the mixture by a shearing speed of 2–50 m/s at 70–95° C. for 3–20 minutes, (c) rapidly stirring and cutting the mixture by a shearing speed of 10–500 m/s for 6–60 minutes, and (d) continuously stirring the mixture by a shearing speed of 0.5–30 m/s for 5–60 minutes to be cooled down to 45° C. for storage.

13 Claims, 1 Drawing Sheet

EMULSION FUEL OIL AND ITS FORMING METHOD

FIELD OF THE INVENTION

The present invention relates to an emulsion fuel oil, and more particularly to a water-in-oil (W/O) type of emulsion fuel oil. The present invention also relates to a method for forming a water-in-oil (W/O) type of emulsion fuel oil.

BACKGROUND OF THE INVENTION

The caloric value of combustion of fuel oil (heavy oil) can be converted to mechanical energy or electric energy, and is generally used in boilers or engines. Many countries have set standards and regulations to control the maximal permissible discharge level of pollutants to protect the environment. Thus, reducing the emitted concentration and amount of pollutants, such as sulfur oxide (SOx), nitrogen oxide (NOx) and carbon oxide (COx) as a result of fossil fuel combustion, is an important subject in environmental protection today.

To overcome the problems described above, some methods were developed to form an emulsion fuel oil by mixing a fuel oil, a water and a specific additive, which reduce the employed quantity of fuel oil so as to dilute the emitted concentration of pollutants.

However, the emulsion fuel oil formed with the additive described in the prior arts has disadvantages of:

1. Instability after long time storage: The resulting emulsion fuel oil is not so stable that the water and the oil are readily separated from each other. Most of the emulsion fuel oil can only maintain its emulsifying stability for a few days at room temperature. Thus, the emulsion fuel oil is usually used immediately as it is formed, and is unfavorable for large-scale production and long-distance transportation.

2. Difficult combustion ignition: It is found that such emulsion fuel oil is not easily ignited, and the caloric value of combustion goes down with increased quantity of water (for example, when the added quantity of water is 20 weight percent, the caloric value of combustion will go down to 70% as that of the same volume of fuel oil.) In addition, the emulsion fuel oil cannot be ignited easily when the added quantity of water is above 30 weight percent, which limits its industrial applicability.

SUMMARY OF THE INVENTION

It is an object of the present invention to provide an emulsion fuel oil having a caloric value of combustion comparable to that of the same volume of fuel oil.

It is another object of the present invention to provide an emulsion fuel oil having lower emitted concentration and amount of pollutants generated from combustion than that of the same volume of fuel oil.

It is an additional object of the present invention to provide an emulsion fuel oil which can be stored for a long period of time without separation of the fuel oil and the water.

It is an additional object of the present invention to provide a method for forming an emulsion fuel oil.

In accordance with an aspect of the present invention, the emulsion fuel oil includes 550–800 parts by weight of a fuel oil, 200–450 parts by weight of a water, and 2–20 parts by weight of an additive including a non-ionic surfactant having an HLB (Hydrophilic-Lipophilic Balance) value ranged from 2.5 to 8, a combustion-assisting reagent, a stabilization reagent and a promotion reagent.

Preferably, the combustion-assisting reagent is a blend of an organic peroxide, an organic solvent and a diluting oil.

Preferably, the stabilization reagent is made by condensation of a phenol compound and a polyol compound.

Preferably, the stabilization reagent is used for forming a stable interface membrane between the fuel oil and the water at 70–95° C.

Preferably, the promotion reagent is an inorganic peroxide.

Preferably, the emulsion fuel oil further includes an antioxidant reagent being one selected from a group consisting of 2,6-di-tert-butyl-p-cresol, 2,6-di-tert-butyl-phenol and 2,6-di-tert-butyl-α-dimethylamino-p-cresol.

Preferably, based on 100 parts by weight of the non-ionic surfactant, the combustion-assisting reagent is 5–60 parts by weight, the stabilization reagent is 1–65 parts by weight, the promotion reagent is 0.1–30 parts by weight, and the antioxidant reagent is 1–30 parts by weight.

In accordance with another aspect of the present invention, the method for forming an emulsion fuel oil includes steps of (a) providing a mixture including 550–800 parts by weight of a fuel oil, 200–450 parts by weight of a water and 2–20 parts by weight of an additive, wherein the additive includes a non-ionic surfactant having an HLB (Hydrophilic-Lipophilic Balance) value ranged from 2.5 to 8, a combustion-assisting reagent, a stabilization reagent and a promotion reagent, (b) stirring the mixture by a shearing speed of 2–50 m/s at 70–95° C. for 3–20 minutes, (c) rapidly stirring and cutting the mixture by a shearing speed of 10–500 m/s for 6–60 minutes, and (d) continuously stirring the mixture by a shearing speed of 0.5–30 m/s for 5–60 minutes to be cooled down to 45° C. for storage.

Preferably, the step (c) produces particles having diameters ranged from 0.3 to 10 μm, and the particles with diameters smaller than 1.5 μm occupy 50–90% of the particles.

Preferably, the step (c) is performed by a stirring device having gear-type blades for cutting the mixture.

Preferably, the combustion-assisting reagent is a blend of an organic peroxide, an organic solvent and a diluting oil.

Preferably, the stabilization reagent is made by condensation of a phenol compound and a polyol compound.

Preferably, the stabilization reagent is used for forming a stable interface membrane between the fuel oil and the water at 70–95° C.

Preferably, the promotion reagent is an inorganic peroxide.

Preferably, the additive further includes an antioxidant reagent being one selected from a group consisting of 2,6-di-tert-butyl-p-cresol, 2,6-di-tert-butyl-phenol and 2,6-di-tert-butyl-α-dimethylamino-p-cresol.

Preferably, based on 100 parts by weight of the non-ionic surfactant, the combustion-assisting reagent is 5–60 parts by weight, the stabilization reagent is 1–65 parts by weight, the promotion reagent is 0.1–30 parts by weight, and the antioxidant reagent is 1–30 parts by weight.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
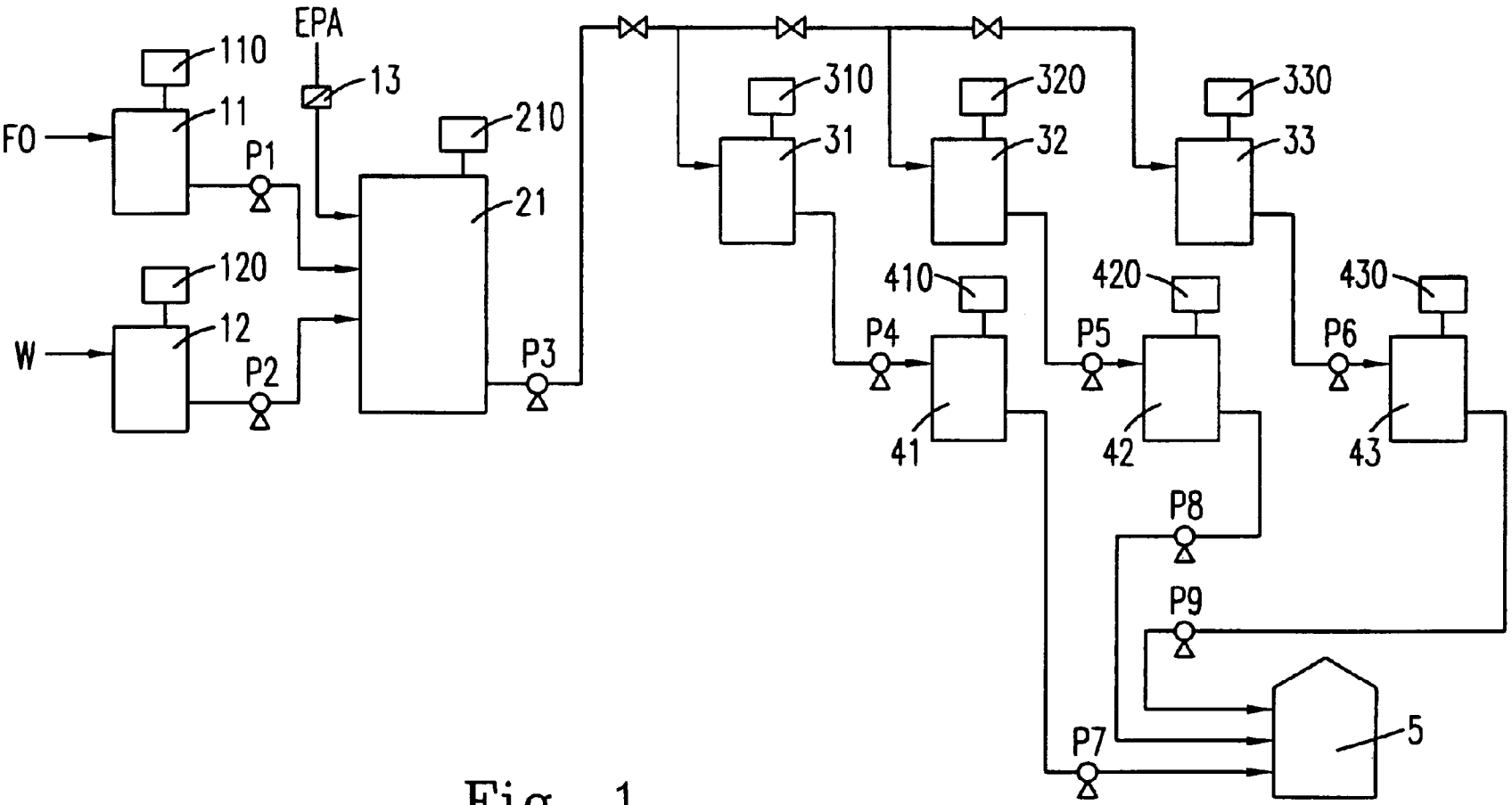
FIG. 1 shows the flow chart for forming the emulsion fuel oil according to the preferred embodiment of the present invention.

Components of Additive:

(1) Component A:

The component A is an emulsion reagent, which is a blend of non-ionic surfactants including emulsion reagent EP-E600 series (such as EP-E635 and EP-E645 that are mainly polyoxyethylene aliphatic acid and commercially available from Chun-Yue Corp., Taipei, Taiwan), SPAN20~80 series, and TWEEN20~80 series for forming water-in-oil (W/O) non-ionic surfactants. Preferably, the HLB (Hydrophilic-Lipophilic Balance) value ranges from 2.5 to 8.

The component A, which has an appropriate HLB value for forming water-in-oil emulsion, is used to provide emulsification effect of the fuel oil and the water so as to generate microexplosion in combustion of the formed emulsion fuel oil and result in complete combustion.

Preferably, the component A includes 30–80 weight percent of polyoxyethylene aliphatic acid, 5–50 weight percent of SPAN20~80, and 5–50 weight percent of TWEEN20~80, based on the total weight of the component A.

(2) Component B:

The component B is a combustion-assisting reagent, which is a blend of an organic peroxide, an organic solvent and a diluting oil. The organic peroxide is used to provide combustion-assisting effect to the emulsion fuel oil. The organic solvent is used to solve the organic peroxide. The diluting oil is used to dilute and/or dissolve the organic peroxide.

The organic peroxide preferably includes but is not limited to benzoyl peroxide, di-tert-butyl peroxide, tert-butyl-peroxy-2-ethyl hexanoate, tert-butyl-peroxy-pivalate and the mixture thereof.

The organic solvent preferably includes but is not limited to diethylene glycol dibutyl ether, dibutyl phthalate, n-butyl acetate, methyl iso-butyl ketone and the mixture thereof.

The diluting oil preferably includes but is not limited to diesel oil, heavy oil and the mixture thereof.

Preferably, the component B includes 50–95 weight percent of the organic peroxide and 5–50 weight percent of the organic solvent, based on the total weight of the component B.

(3) Component C:

The component C is a stabilization reagent made by condensation of a component C1 and a component C2, which can form a stable interface membrane between the fuel oil and the water at 70–95° C. in the process of emulsification under suitable reaction condition. The stabilization reagent EP-S100 of the present invention is commercially available from Chun-Yue Corp., Taipei, Taiwan. The emulsion fuel oil formed with such stabilization reagent can be stored for a long period of time without separation of the fuel oil and the water.

The component C1 is a phenol compound which preferably includes but is not limited to methyl-phenol, dimethyl-phenol, butyl-phenol, octyl-phenol, sec-octyl-phenol, decyl-phenol and the mixture thereof.

The component C2 is a polyol compound which preferably includes but is not limited to ethylene glycol, 1,2-propanediol, glycerol, pentaerythritol and the mixture thereof.

(4) Component D:

The component D is a promotion reagent which is used to promote emulsification of the fuel oil and the water, and promote reaction between the component C1 and the component C2 for forming an interface membrane. The component D is an inorganic peroxide which preferable includes but is not limited to potassium permanganate, sodium permanganate and potassium bichromate.

(5) Component E:

The component E is an antioxidant reagent which is used to prevent deterioration due to oxidation, such that the formed emulsion fuel oil can be stored for a long period of time. A general antioxidant (or antiseptic) can be used as the component E, such as 2,6-di-tert-butyl-p-cresol, 2,6-di-tert-butyl-phenol and 2,6-di-tert-butyl-a-dimethylamino-p-cresol.

Preferably, based on 100 parts by weight of the component A, the emulsion fuel oil additive of the present invention is prepared by using 5–60 parts by weight of the component B, 0.5–20 parts by weight of the component C1, 0.5–45 parts by weight of the component C2, 0.1–30 parts by weight of the component D, and 1–30 parts by weight of the component E.

Method for Forming The Emulsion Fuel Oil:

(1) Low Speed Mixing Reaction:

A fuel oil, a water and the forgoing additive are put together into a reactor having a stirring device to form a mixture including 550–800 parts by weight of the fuel oil, 200–450 parts by weight of the water (the total content of the fuel oil and the water is 1000 parts by weight) and 2–20 parts by weight of the additive. The mixture is stirred by a rotational speed of 300–1000 RPM (the shearing speed is about 2–50 m/s for a stirring device with a diameter of 30–300 cm) for 3–20 minutes, and the temperature of the reactor and the mixture is kept at 70–95° C. This step uses the mechanical force of the stirring device to promote the dispersion of the oil phase and the water phase, and by the function of the surfactant, this step further promotes the particles in the oil and the water phases to mix adequately and proceed an initial reaction.

(2) High Speed Mixing And Cutting Reaction:

The rotational speed of the stirring device is increased to 1000–5000 RPM (the shearing speed is about 10–500 m/s for a stirring device with a diameter of 30–300 cm) for rapidly mixing and cutting the mixture for 6–60 minutes. It's not necessary to keep the temperature of the reactor at 70–95° C. in this step, and the temperature can be decreased for 5–20° C. This step uses the centrifugal force and the shearing force provided by the stirring device to hit and cut the particles and further disperse the particles in the oil and the water phases. The physical environment created by rapid stirring and cutting is helpful for using the function of the high-energy groups in the additive to cut the long carbon chains of the fuel oil into short carbon chains and bond with the water molecules to form new compounds.

The structure of the stirring device used in this step affects significantly the combustion efficiency of the fuel oil. To achieve better efficiency and increase the production yield of the formed emulsion fuel oil, the blades of the stirring device is preferably cutter-type blades having cutting function. The particles formed in this rapid stirring step have diameters ranged from 0.3 to 10 $\mu$m, and the particles with diameters smaller than 1.5 $\mu$m occupy 50–90% of the total particles so that the formed emulsion fuel oil has better efficiency.

The alkanes of the heavy oil have long carbon chains, while the aromatic hydrocarbons have covalent electron structures whose bonds are much easier to break than that of saturated hydrocarbons. In this step, due to the thermal energy provided by the high-energy groups in the additive accompanying the proper temperature and the physical environment created by rapid stirring and cutting, the heavy oil having long carbon chains and covalent bonds can be broken and cut into short chain hydrocarbons. With increased amount of the short chain hydrocarbons, the caloric value of combustion goes up and the thermal energy released during combustion also goes up.

(3) Low Speed Mixing And Cutting Reaction:

In this step, the mixture is cooled and stirred to prevent the particles in the discontinuous water phase from combining into macromolecules, due to the high temperature in the beginning of the cooling process, which destroys the emulsion effect. The stirring speed cannot be too fast for maintaining the stable interface between the oil phase and the water phase formed at a low temperature. If the stirring speed is too fast, the two phases will be disturbed and the water molecules will combine each other into macromolecules, which causes the separation of the oil and the water. The optimal rotational speed is about 40–800 RPM (the shearing speed is about 0.5–30 m/s for a stirring device with a diameter of 30–300 cm). The emulsion fuel oil should be stirred until the temperature thereof is below 45° C., and preferably between 20–45° C.

In principle, it is not necessary to cool down the temperature by a cooling system unless for reducing the production time. The time for cooling down the temperature from the high temperature in the step (2) to below 45° C. is at least 5–60 minutes to prevent the formation of unstable interface between the oil phase and the water phase, which causes the separation of the oil and the water during long-term storage later.

According to the method for forming the emulsion fuel oil of the present invention, the stabilization reagent EP-S100 is used for forming a stable interface membrane between the oil phase and the water phase, and the combustion-assisting reagent is used for improving ignition and combustion of the emulsion fuel oil. Therefore, the emulsion fuel oil of the present invention can be ignited easily even with the increase of the quantity of water.

(4) Storage:

The emulsion fuel oil of the present invention is formed after the forgoing step (3) is accomplished. This product can be stored over one year without separation of the fuel oil and the water if it is stored below 45° C. in an airtight storage container. If it is stored in a usual storage container, little water will be generated at the bottom of the container after a period of time due to the mist in the air, but the quantity of the water is less than that of the general fuel oil which is stored in the same condition and period of time. To ensure the quality of the emulsion fuel oil during combustion, a circulation device can be set in the oil tank of the boiler that the water generated from the mist in the air is mixed into the emulsion fuel oil without existing as a single water phase.

EXAMPLE 1

FIG. 1 shows the flow chart for forming the emulsion fuel oil according to the preferred embodiment of the present invention. The equipment is designed for producing one ton of the emulsion fuel oil per batch and the production time per batch is between 15–30 minutes. The production process is as follows:

The fuel oil (600 kg) and the water (400 kg) which are both preheated to 40–60° C. are put into heating tanks 11 and 12, respectively, and the heating tanks 11 and 12 are then heated to 75–90° C. in 10–20 minutes. The heating tanks 11 and 12 are heated by 5–8 atm steam through heating tubes in the tanks, and have low speed stirring device 110 and 120 with a rotational speed of 30–60 RPM to uniform the temperature of the oil or the water in the tank.

Subsequently, the fuel oil and the water in the heating tanks 11 and 12 are pumped into an initial reactor 21 having a capacity of one ton by an oil pump P1 and a water pump P2, respectively. The additive EPA (5 kg) is also injected into the reactor 21 by an auto-injector 13. The reactor 21 has a stirring device 210 with general blades. The rotational speed of the stirring device 210 is 500–700 RPM to mix completely the fuel oil, the water and the additive to proceed with the initial reaction. In this embodiment, the reactor 21 is heated by steam-type heating tubes to maintain the temperature at 75–90° C. for 6–9 minutes of the reaction time.

Except aforementioned steam-type heating tubes, the reactor can also be heated by an electric-heating method or other heating methods.

After the forgoing reaction of low speed mixing is accomplished, the formed oil is pumped into three reactors 31, 32 and 33 (with stirring devices 310, 320 and 330 respectively) in turn by an oil pump P3 for proceeding the rapidly mixing and cutting reaction. One of the specific characteristics of the stirring device 310, 320 and 330 in this step is that the stirring blades are gear-type blades having cutting function or other blades having cutting function. The reaction time is 14–24 minutes, and the rotational speed of the stirring device is 1400–3000 RPM. It is not necessary to isolate heat dispersion in this step, and the temperature of the reactor can be naturally cooled down with the temperature of outer environment. Since the reaction time in this step is three times of the reaction time in the last step, the formed mixture from the last step is pumped into three reactors 31, 32 and 33 in turn in this step to balance the reaction time of this and the last steps to increase the production rate.

Subsequently, the formed oil in the reactors 31, 32 and 33 are pumped into their corresponding reactors 41, 42 and 43 (with stirring devices 410, 420 and 430 respectively) by oil pumps P4, P5 and P6. A cooling device (not shown) is set in the reactor for cooling down the temperature when stirring. The cooling device used in the present invention is made of cooling tubes which surround the reactor and have cooling water circulating therein. The cooling device can cool down the temperature of the reactor to 30–45° C. in 10–25 minutes. In the cooling process of this step, the reaction to stabilize the oil and the water phases of the mixture in the reactor is still going on. Therefore, the stirring device is set in the reactor for completely mixing the mixture, and evening the temperature of the mixture to increase the cooling rate. The rotational speed of the stirring device in this step is between 100–400 RPM, and the stirring blades are general blades.

Except by the cooling water circulating in the cooling tubes, the reactor can also be cooled by an air-cooling method or other cooling methods.

Finally, the formed emulsion fuel oil is pumped into a storage tank 5 by pumps P7, P8 and P9. A circulation device can be set in the storage tank 5 that the molecules of the emulsion fuel oil distribute stably in the oil and the water phases to maintain the quality of the emulsion fuel oil.

EXAMPLES 2–10

Except the using quantities of the fuel oil, the water and the additive, other processes for forming the emulsion fuel oil are the same as that of Example 1. The using quantities of the fuel oil, the water and the additive are listed in Table 1.

TABLE 1

| Example | Fuel oil (kg) | Water (kg) | Additive (kg) |
|---|---|---|---|
| 2 | 550 | 450 | 20 |
| 3 | 550 | 450 | 8 |
| 4 | 600 | 400 | 12 |
| 5 | 600 | 400 | 5 |
| 6 | 600 | 400 | 2 |
| 7 | 700 | 300 | 6 |
| 8 | 700 | 300 | 12 |
| 9 | 800 | 200 | 6 |
| 10 | 800 | 200 | 14 |

Results:

When compared with the same volume of fuel oil, the caloric value of combustion of the emulsion fuel oil, which is formed by mixing the fuel oil, the water and the additive according to the respective examples described above, is comparable. Moreover, the emission of pollutants after combustion of the emulsion fuel oil is about 40–60% as that of the same volume of fuel oil. After tested in boilers for combustion, the emitted concentrations of NOx and SOx of the emulsion fuel oil are respectively 120–160 ppm and 180–260 ppm, which are much lower than that of fuel oil under the same condition and equipment (the emitted concentrations of NOx and SOx of fuel oil are measured as 240–380 ppm and 350–470 ppm, respectively). In addition, the emulsion fuel oil of the present invention can be stored for over one year below 45° C. without separation of the fuel oil and the water.

In conclusion, the emulsion fuel oil of the present invention has the following advantages:

1. The emulsion fuel oil of the present invention has a caloric value of combustion comparable to that of the same volume of fuel oil.

2. The emulsion fuel oil of the present invention has lower emission of pollutants than that of the same volume of fuel oil.

3. The emulsion fuel oil of the present invention can be stored over one year below 45° C. without separation of the fuel oil and the water, so that it's suitable for large-scale production and long-distance transportation.

4. The emulsion fuel oil can be ignited easily when the added quantity of water is 30 weight percent, and still has a caloric value of combustion comparable to that of the same volume of fuel oil when the added quantity of water is 45 weight percent.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An emulsion fuel oil with a total content of 1000 parts in weight, comprising:

550–800 parts by weight of fuel oil;

200–450 parts by weight of water; and

2–20 parts by weight of an additive comprising a non-ionic surfactant having an HLB (Hydrophilic-Lipophilic Balance) value ranged from 2.5 to 8, a combustion-assisting reagent, a stabilization reagent and a promotion reagent, wherein said combustion-assisting reagent is a blend of an organic peroxide, an organic solvent and a diluting oil, said stabilization reagent is made by condensation of a phenol compound and a polyol compound, and said promotion reagent is an inorganic peroxide.

2. The emulsion fuel oil according to claim 1, wherein said stabilization reagent is used for forming a stable interface membrane between said fuel oil and said water at 70–95° C.

3. The emulsion fuel oil according to claim 1, further comprising an antioxidant reagent being one selected from a group consisting of 2,6-di-tert-butyl-p-cresol, 2,6-di-tert-butyl-phenol and 2,6-di-tert-butyl-α-dimethylamino-p-cresol.

4. The emulsion fuel oil according to claim 3, wherein based on 100 parts by weight of said non-ionic surfactant, said combustion-assisting reagent is 5–60 parts by weight, said stabilization reagent is 1–65 parts by weight, said promotion reagent is 0.1–30 parts by weight, and said antioxidant reagent is 1–30 parts by weight.

5. A method for forming an emulsion fuel oil, comprising steps of:

(a) providing a mixture comprising 550–800 parts by weight of a fuel oil, 200–450 parts by weight of a water and 2–20 parts by weight of an additive, wherein said additive comprises a non-ionic surfactant having an HLB (Hydrophilic-Lipophilic Balance) value ranged from 2.5 to 8, a combustion-assisting reagent, a stabilization reagent and a promotion reagent;

(b) stirring said mixture by a shearing speed of 2–50 m/s at 70–95° C. for 3–20 minutes;

(c) rapidly stirring and cutting said mixture by a shearing speed of 10–500 m/s for 6–60 minutes; and (d) continuously stirring said mixture by a shearing speed of 0.5–30 m/s for 5–60 minutes to be cooled down to 45° C. for storage.

6. The method according to claim 5, wherein said step (c) produces particles having diameters ranged from 0.3 to 10 μm, and said particles with diameters smaller than 1.5 μm occupy 50–90% of said particles.

7. The method according to claim 5, wherein said step (C) is performed by a stirring device having gear-type blades for cutting said mixture.

8. The method according to claim 5, wherein said combustion-assisting reagent is a blend of an organic peroxide, an organic solvent and a diluting oil.

9. The method according to claim 5, wherein said stabilization reagent is made by condensation of a phenol compound and a polyol compound.

10. The method according to claim 5, wherein said stabilization reagent is used for forming a stable interface membrane between said fuel oil and said water at 70–95° C.

11. The method according to claim 5, wherein said promotion reagent is an inorganic peroxide.

12. The method according to claim 5, wherein said additive further comprises an antioxidant reagent being one selected from a group consisting of 2,6-di-tert-butyl-p-cresol, 2,6-di-tert-butyl-phenol and 2,6-di-tert-butyl-α-dimethylamino-p-cresol.

13. The method according to claim 12, wherein based on 100 parts by weight of said non-ionic surfactant, said combustion-assisting reagent is 5–60 parts by weight, said stabilization reagent is 1–65 parts by weight, said promotion reagent is 0.1–30 parts by weight, and said antioxidant reagent is 1–30 parts by weight.

* * * * *